United States Patent [19]

Ushiyama et al.

[11] Patent Number: 5,001,778

[45] Date of Patent: Mar. 19, 1991

[54] PORTABLE RADIO RECEIVER

[75] Inventors: Katsumi Ushiyama; Sadafumi Sakamoto; Giho Makino, all of Tokyo; Kiyohiko Itoh, Sapporo, all of Japan

[73] Assignee: Kokusai Electric Co., Ltd., Tokyo, Japan

[21] Appl. No.: 365,351

[22] Filed: Jun. 13, 1989

[30] Foreign Application Priority Data

Nov. 7, 1988 [JP] Japan ..... 63-279505

[51] Int. Cl.[5] ..... H01Q 1/38

[52] U.S. Cl. ..... 455/254; 455/269; 343/702; 343/700 MS

[58] Field of Search ..... 455/89, 90, 269, 347, 455/351, 254; 343/702, 746, 795, 800, 745, 700 MS

[56] References Cited

U.S. PATENT DOCUMENTS

| | | | |
|---|---|---|---|
| 4,367,474 | 1/1983 | Schaubert et al. | 343/700 MS |
| 4,641,366 | 2/1987 | Yokoyama et al. | 455/90 |
| 4,791,423 | 12/1988 | Yokoyama et al. | 343/702 |
| 4,803,491 | 2/1989 | Hikuma | 455/89 |
| 4,829,591 | 5/1989 | Hashimoto et al. | 455/89 |
| 4,876,552 | 10/1989 | Zakman | 455/89 |

*Primary Examiner*—Curtis Kuntz

*Attorney, Agent, or Firm*—Emmanuel J. Lobato; Robert E. Burns

[57] ABSTRACT

A portable radio receiver assembled in a case. In accordance with the present invention, the case is also employed as an antenna of the portable receiver. The case is composed of a pair of parallel-opposed square conductor plates interposed therebetween a space sufficiently smaller than the wavelengths of received waves of the portable radio receiver, a frame of insulating material interposed in the space. Feeding terminals of the portable radio receiver are provided at desired positions on one pair of opposed sides of the parallel-opposed square conductor plates. Each of short-circuit elements of high-frequency-wise is provided on other pair of opposed sides of the parallel-opposed square conductor plates so that the direction of the plane of polarization of the antenna can be changed by short-circuiting any one of the short-circuit elements. A control circuit is provided in the case for selectively short-circuiting one of the short-circuit elements to obtain a larger received output from the feeding terminals.

8 Claims, 4 Drawing Sheets

PORTABLE RADIO RECEIVER

BACKGROUND OF THE INVENTION

The present invention relates to a portable radio receiver.

Conventionally, portable radio receivers mostly employ loop antennas or monopole antennas and they are adapted for operation primarily in the plane of vertical polarization. In receiving electric waves sent as vertically polarized waves from the transmitting station, a service area of communication greatly varies depending upon whether the receiving antenna is held vertical or horizontal.

For example, in a case of a card-typed pager receiver utilizing a loop antenna, its receiving sensitivity markedly differs depending upon whether the receiver is held vertical or horizontal, and this poses a problem in the actual use of the receiver In conventional radio receivers, however, no measures have been taken against this desadvantage.

For example, the prior art pager receiver is equipped with an antenna in such a manner that the receiving sensitivity is maximum when it is carried vertically in a breast pocket of user's shirt, but in practice, it is often carried in a pocket of a jacket, a bag, a handbag, or the like. In such a case, the pager receiver is usually laid at its side, that is, it is kept in the direction in which the directivity of the antenna is the lowest, resulting in the coverage of communication being seriously impaired.

SUMMARY OF THE INVENTION

An object of the present invention is to provide a portable radio receiver which permits automatic adjustment of the plane of polarization of its antenna to the direction in which the receiving sensitivity increases, regardless of the direction of the receiver, so as to enlarge the distance range of communication.

To solve the above problem and attain the above object, there is provided a portable radio receiver of the present invention comprising: a case, employed also as an antenna of the portable receiver, composed of a pair of parallel-opposed square conductor plates interposed therebetween a space sufficiently smaller than the wavelengths of received waves of the portable radio receiver, a frame of insulating material interposed in the space, feeding terminals of the portable radio receiver provided at desired positions on one pair of opposed sides of the parallel-opposed square conductor plates, and short-circuit elements of high-frequencywise each provided on other pair of opposed sides of the parallel-opposed square conductor plates so that the direction of the plane of polarization of the antenna can be changed by short-circuiting any one of the short-circuit elements; and a control circuit provided in the case for selectively short-circuiting one of the short-circuit elements to obtain a larger received output from the feeding terminals. The feeding terminals are provided at one pair of opposed corners of the square conductor plates, while the short-circuit elements are provided at other pairs of opposed corners of the square conductor plates.

With such an arrangement, the direction of the plane of polarization of the antenna is switched to an optimum direction in accordance with the state of use of the receiver to thereby maintain excellent reception That is, it is possible to overcome the defect of the prior art that the direction of the antenna varies according to the state of the receiver being carried and the receiving sensitivity decreases accordingly, resulting in deteriorated reception.

BRIEF DESCRIPTION OF THE DRAWINGS

The present invention will be described in detail below with reference to the accompanying drawing, in which.

DETAILED DESCRIPTION

Figure 1A:
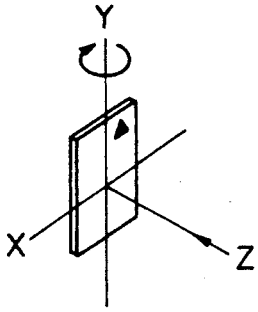
FIGS. 1A, 1B, 1C and 1D are diagrams explanatory of the electric wave incoming direction to a conventional pager receiver and its directional patterns obtained by measuring its receiving sensitivity.
Figure 1B:
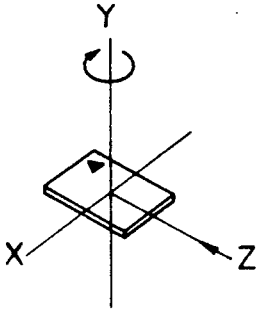
Figure 1C:
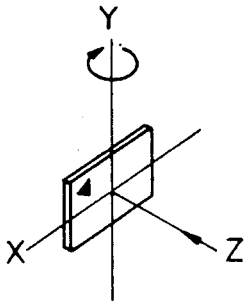

With reference to FIGS. 1A, 1B, 1C and 1D, directional patterns of the receiving sensitivity of a card typed pager receiver will first be described. The values indicated were obtained by measuring the receiving sensitivity to vertically polarized electric waves incoming from Z-axis direction at each 45° rotation angle of the receiver about the Y axis. In FIG. 1 the receiving sensitivity, indicated in decibel, decreases to inner ones of the concentric circles. The directional patterns in the cases of the pager receiver being placed (1A) vertically (longigudinally), (1B) horixontally, and (1C) sideways are indicated by the solid line, the broken line, and the one-dot chain line respectively. It is evident from FIGS. 1A, 1B and 1C that the sensitivity is significantly low when the pager receiver is held sideways as shown in FIG. 1C.

Figure 2A:
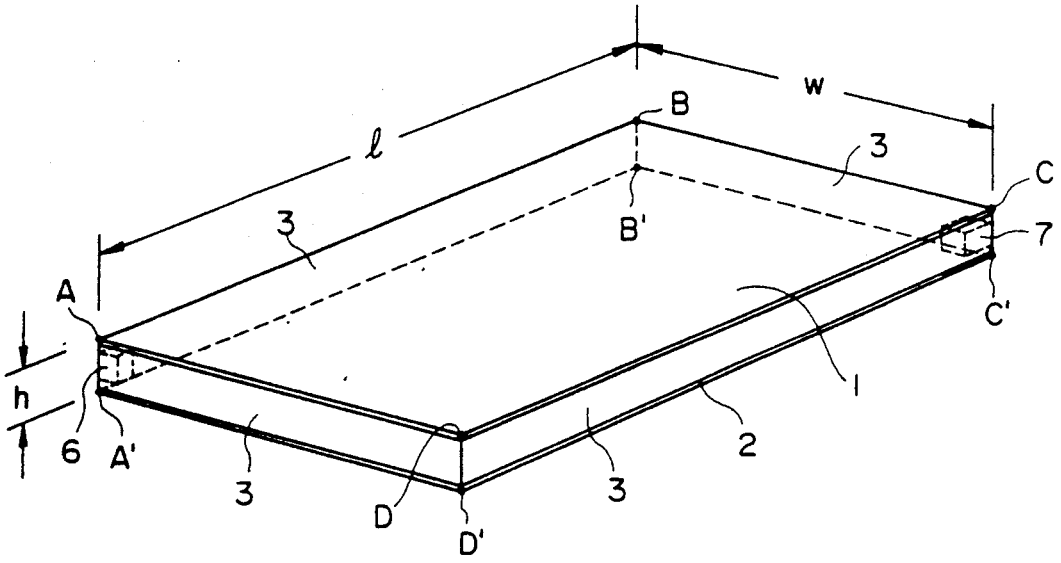
FIG. 2A is a perspective view showing the construction of the radio receiver of the present invention.
Figure 2B:
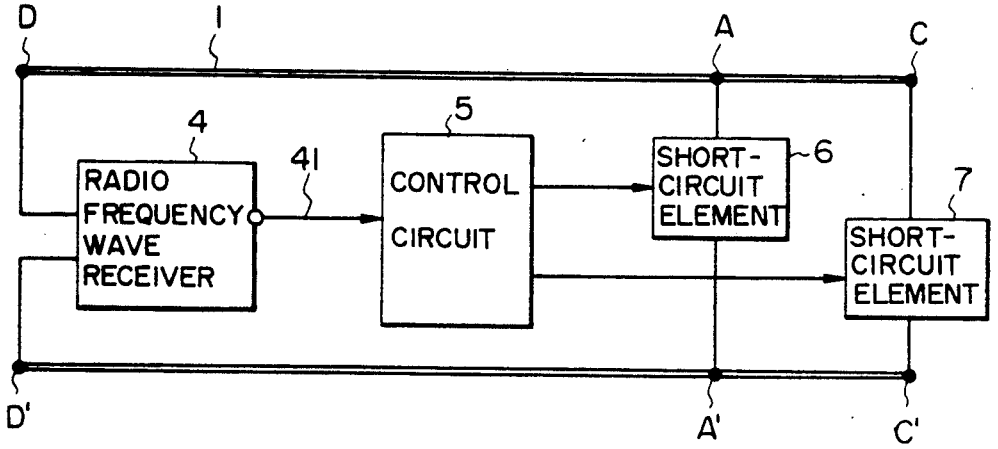
FIG. 2B is a system diagram of the radio receiver.

FIGS. 2A and 2B are a perspective view and a short-circuit element control system diagram showing the portable radio receiver of the present invention as being applied to a thin (card type) pager receiver.

In FIGS. 2A and 2B, reference numerals 1 and 2 indicate a pair of parallel-opposed square conductor plates with a space h sufficiently smaller than the wavelengths of received radio waves, and 3 designates an insulating frame interposed between the pair of conductor plates 1 and 2. The conductor plates and the insulating frame constitute the receiver case and, at the same time, operate as a flat loop antenna.

In this embodiment the receiver case is a flat rectangular prism equipped with a length l of 80 mm, a width W of 50 mm and a height (a thickness) h=3.6 mm, and this caseantenna combination has incorporated therein a radio frequency wave receiver 4, a control circuit 5 and a plurality of short-circuit elements 6 and 7.

The radio frequency wave receiver 4 is provided with a receiving electric field strength detector commonly referred to as RSSi (Receiving Signal Strength indicator), which receives received signals from feeding points D and D' and yields a detected output 41. The control circuit 5 short-circuits in succession the short-circuit elements 6 and 7 provided at the corners A, A', C and C' of the plate antenna, compares their detected outputs 41 with one another, that is, the received outputs, and selectively short-circuits one of the short-circuit elements which provides a maximum output value.

The feeding points are provided at desired positions on one side of the pair of conductor plates 1 and 2 opposed in parallel, i.e. at a pair of opposed corners of the plates in this embodiment, and the shor-circuit elements 6 and 7 are provided at two more desired opposite positions on the other sides of the plates, i.e. at the other opposite corners A, A', C and C' in this embodiment. Under control of the control circuit 5 any one of the short-circuit elements 6 and 7 is actuated to short-circuit the conductor plates 1 and 7 in a high frequency-wise, causing them to serve as the flat loop antenna.

Figure 3A:
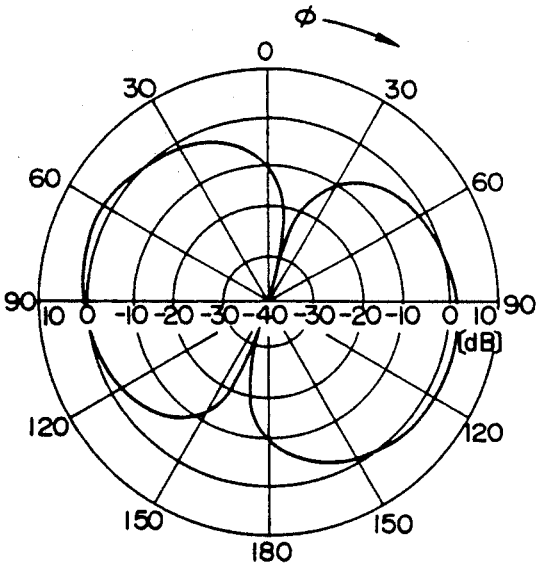
FIGS. 3A, 3B, 3C and 3D are diagrams showing antenna directional patterns of an embodiment of the radio receiver of the present invention according to the antenna short-circuit positions.
Figure 3B:
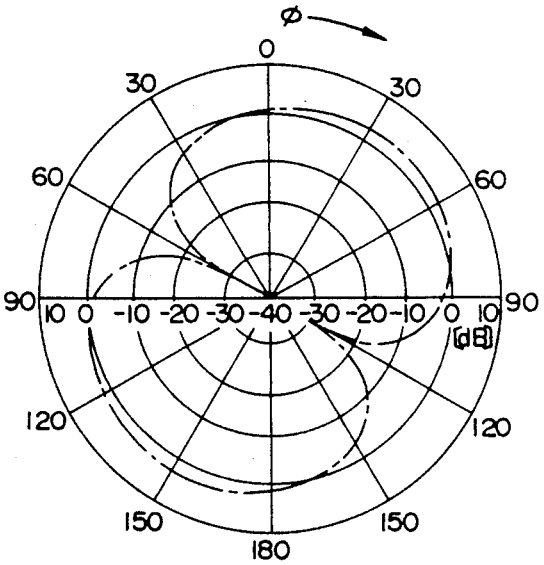
Figure 3C:
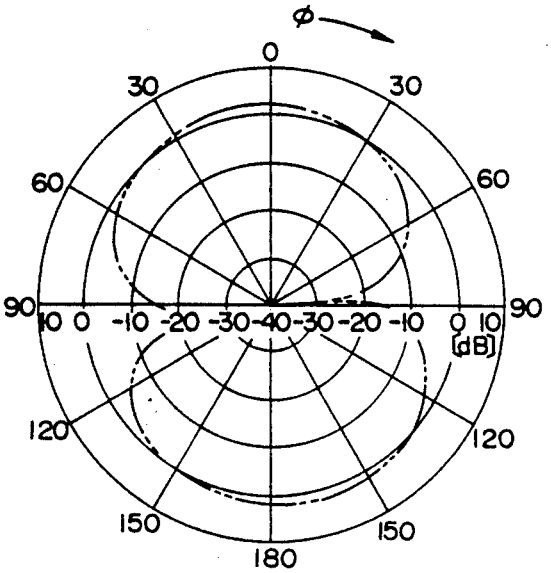
Figure 3D:
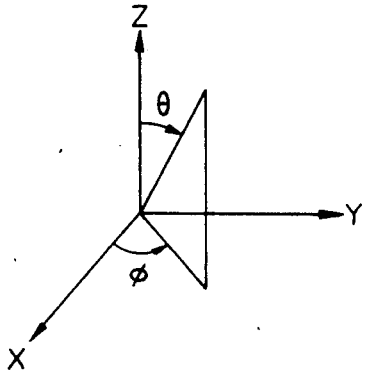

FIGS. 3A, 3B and 3C show gain characteristics of the antenna of this embodiment with its plane of polarization in the Z-axis direction in cases where feeding points are provided at the corners D and D' and the corners A and A', B and B', C and C' are short-circuited, respectively. A notation $\theta$ in FIG. 3D indicates inclination of a plane of polarization from the X axis. That is, polarized waves with $\theta=0°$ and $\theta=90°$ are parallel to the X axis and the Y axis, respectively. In any case, the direction of plarization for a polarized wave of high radiation field intensity is substantially in agreement with the direction in which the short-circuit point is viewed from the feeding point.

Figure 1D:
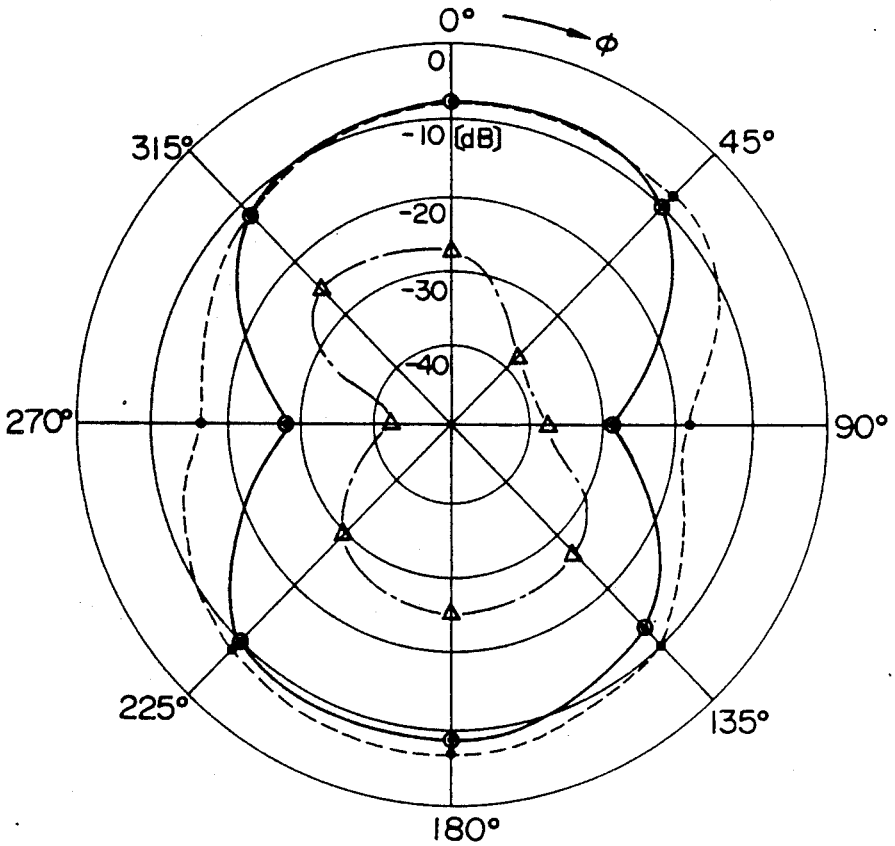

As is evident from FIGS. 3A to 3D, the polarized wave directivity characteristics of the receiving field can be changed by shifting the short-circuit points of the pair of parallel-opposed conductor plates 1 and 2 to desired positions on their marginal edges, and the directivity of the antenna can be held to be optimum with respect to the electric wave incoming direction through automatic control of the positions of the feeding points This can be confirmed by FIGS. 1A to 1C. That is, FIGS. 1D shows measured values when the short-circuit elements C and C' were short-circuited, and in the case of FIG. 1C, the receiving sensitivity is markedly low, but it was confirmed that the receiving sensitivity would be equal to that in the case of FIG. 1A by switching the short-circuit points to A and A'.

Figure 4:
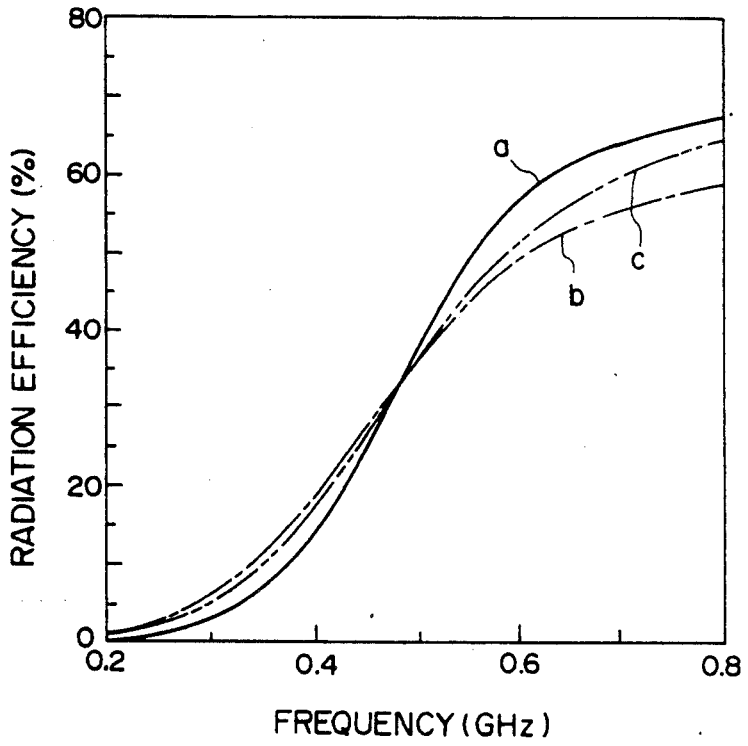
FIG. 4 shows characteristic diagrams showing variations of the antenna radiation efficiency in the embodiment.

The curves a through c in FIG. 4 show variations of the radiation efficiency relative to frequency when the opposed corners A and A', B and B', or C and C' were short-circuited, respectively. It was ascertained that the resonance frequency would undergo substantially no variation, even when pair of opposed points A and A', B and B' or C and C' are short-circuited, and that substantially the same radiation efficiency at a resonance frequency could also be obtained regardless of the short-circuit point.

In the above the short-circuit points between the pair of conductor plates 1 and 2 disposed in parallel are described to be switched between the points A, A' and C, C' so as to facilitate a better understanding of the invention. However, it was confirmed that the same effect as mentioned above could also be obtained when the short-circuit elements are provided at a plurality of desired points such as B, B'.

The short-circuit elements 6 and 7 need only to be shorted in a high-frequency-wise and they can be implemented by pin diodes or varicap diodes.

As will be appreciated from the above, according to the present invention, the antenna structure can also be used as the receiver case, and consequently, the radio receiver can be miniaturized. Furthermore, the directivity of the antenna can always be held to be optimum with respect to the electric wave incoming direction. Accordingly, the present invention is highly effective not only for the manufacture of miniature, lightweight and thin (card-like) portable radio receivers but also for improving the coverage of communication.

What we claim is:

1. For use in a portable radio receiver comprising, a case effective as an antenna and having two conductor plates disposed parallel with major surfaces thereof in opposed relationship spaced from each other a distance less than the wavelength of received radio frequency waves and defining a space therebetween, a frame made of an insulating material disposed between said conductor plates and around said space defining jointly with said conductor plates said case, input terminals for inputting the received radio frequency waves into the receiver and disposed on respective sides of the conductor plates, means for automatically changing the plane of polarization of the antenna to a direction in which the receiving sensitivity of the antenna increases to optimize reception of the received radio frequency waves by the antenna and the input terminals comprising short-circuiting high-frequency elements disposed in said case in contact with opposed sides of the conductor plates at points spaced along the opposed sides of the conductor plates, a control circuit connected to said elements for automatically selectively short-circuiting the conductor plates by application of an output thereof to one of said short-circuiting elements to cause said plates to function as a flat loop antenna, and detector means connected to the control circuit for detecting a field strength of an input of the input terminals and for applying a detected input value to said control circuit.

2. For use in a portable radio receiver according to claim 1, in which said points are disposed at diagonally opposite corners of the opposed conductor plates.

3. For use in a portable radio receiver according to claim 1, in which said input terminals are connected to the opposed conductor plates at a corresponding marginal end portions of a major surface of the conductor plates.

4. For use in a portable radio receiver according to claim 1, in which said detector means comprises an electric field strength detector disposed in said case.

5. For use in a portable radio receiver according to claim 4, in which said short-circuiting elements are disposed at points spaced different distances from the input terminals.

6. For use in a portable radio receiver according to claim 1, in which said detector means and said control circuit are disposed in said case.

7. For use in a portable radio receiver according to claim 1, in which said conductor plates are rectangular.

8. For use in a portable radio receiver comprising, a case effective as a flat loop antenna comprising two conductor plates disposed parallel having major surfaces thereof opposed and spaced from each other a distance less than the wavelength of radio frequency waves received, a frame between said conductor plates enclosing a space between the conductor plates and defining jointly with the conductor plates said case, input terminals connected to the antenna for inputting the radio frequency waves received into the receiver, short circuiting means for short-circuiting the conductor plates at different points, to effectively cause the conductor plates to function as a flat loop antenna, means to automatically vary the different points at which said conductor plates are short-circuited to vary the plane of polarization of the antenna to optimize the direction of the antenna and input of the radio frequency waves into the receiver, and means for varying said plane of polarization as a function of a detected electric field strength generated by received signals from the input terminals.

* * * * *